US008594547B2

(12) United States Patent
Montfort et al.

(10) Patent No.: US 8,594,547 B2
(45) Date of Patent: Nov. 26, 2013

(54) CONSTRAINED TRANSFER ASSIST BLADE (CTAB) FOR IMPROVED PRINT TO EDGE PERFORMANCE

(75) Inventors: David Bradley Montfort, Webster, NY (US); Donald Clifford Koch, Ontario, NY (US); Eliud Robles Flores, Webster, NY (US); John R. Falvo, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 267 days.

(21) Appl. No.: 13/103,244

(22) Filed: May 9, 2011

(65) Prior Publication Data

US 2012/0288307 A1 Nov. 15, 2012

(51) Int. Cl.
*G03G 15/16* (2006.01)

(52) U.S. Cl.
USPC ..... 399/316

(58) Field of Classification Search
USPC ..... 399/310, 316, 317
See application file for complete search history.

(56) References Cited

U.S. PATENT DOCUMENTS

| | | | | |
|---|---|---|---|---|
| 6,233,423 | B1 | 5/2001 | Fletcher et al. | |
| 6,556,805 | B1 * | 4/2003 | Kuo et al. | 399/316 |
| 6,687,480 | B2 * | 2/2004 | Obrien et al. | 399/316 |
| 6,766,138 | B2 * | 7/2004 | Bonacci et al. | 399/316 |
| 7,356,297 | B2 | 4/2008 | Montfort et al. | |
| 7,424,258 | B2 * | 9/2008 | Sugawara et al. | 399/316 |
| 7,471,922 | B2 | 12/2008 | Robles-Flores et al. | |
| 2003/0108369 | A1 | 6/2003 | Kuo et al. | |
| 2007/0212130 | A1 * | 9/2007 | Kuwabara et al. | 399/316 |
| 2009/0080951 | A1 * | 3/2009 | Montfort et al. | 399/316 |

* cited by examiner

*Primary Examiner* — Sandra Brase
(74) *Attorney, Agent, or Firm* — Fay Sharpe LLP

(57) ABSTRACT

An imaging forming device and a constrained transfer assist blade (CTAB) that provides for faster printing speeds, with an improved image-to-edge border specification is disclosed. An upper blade layer constrains pressure blades towards a lifter assembly in order to prevent the lower lying pressure blades from delaminating and a wear layer is formed around outer edges of the blade. Faster response times and improved trail edge flip defects as well as printing closer to the sheet edges is enabled.

16 Claims, 5 Drawing Sheets

CONSTRAINED TRANSFER ASSIST BLADE (CTAB) FOR IMPROVED PRINT TO EDGE PERFORMANCE

BACKGROUND

This disclosure relates generally to ionographic or electrophotographic imaging and printing apparatuses or reproduction machines, and more particularly is directed to a constrained transfer assist blade assembly for contacting a printing media.

Electrostatographic printing includes the well-known process of transfer. In transfer, charged toner particles from an image-bearing photoreceptor member are transferred to an image support substrate or print media, such as a copy sheet. Transfer is accomplished at a transfer station, wherein the transfer occurs by electro-statically overcoming adhesive forces holding the toner particles to the image-bearing member, thus transferring the developed toner image to the substrate.

In conventional electrostatographic machines, transfer is achieved by transporting the image support substrate into the area of the transfer station. The transfer station applies electrostatic force fields sufficient to overcome the adhesive forces holding the toner to the photoreceptor surface in order to attract and transfer the toner particles onto the image support substrate. In general, such electrostatic force fields are generated by means of electrostatic induction using a corona-generating device such as, for example, a dicorotron. The copy sheet is placed in direct contact with the developed toner image on the photoreceptor surface while the reverse side of the copy sheet is exposed to a corona discharge. This corona discharge generates ions having a polarity opposite to that of the toner particles, thereby electro-statically attracting and transferring the toner particles from the photoreceptive member to the image support substrate.

During electrostatic transfer of a toner image to a copy sheet, it is important for the copy sheet to be held in direct, uniform and intimate contact with the photoconductive surface and the toner image developed thereon. Unfortunately, however, the interface between the photoreceptive surface and the copy substrate is not always optimal. Various substrate conditions such as copy sheets being mishandled, wrinkled, creased, left exposed to the environment, or previously processed by a heat and pressure fusing or fixing operation, result in insufficient substrate contact with the photoreceptor surface during transfer. This substrate condition creates spaces or air gaps between the developed image on the photoreceptor surface and the copy sheet. The air gaps, in turn, impair transfer of the toner image, thus causing copy defects.

It is known to use a transfer assist blade (TAB) in the transfer process. Such transfer assist blades mechanically press the print media into substantially uniform intimate contact with the image-bearing surface, just prior to the build-up of the transfer electrostatic field. However, an electrostatic interaction may occur between the TAB member and the copy substrate. This is because the transfer-assist pressure blade is located in the transfer zone between the transfer corona-generating device, such as a dicorotron, and the photoreceptor. As a result, a measurable electrostatic charge is imparted on the blade member by the transfer dicorotron. In particular, the TAB tends to delaminate at higher actuation speeds that lead to print defects and backside sheet contamination. Once the TAB tip becomes charged, for example, the blades can splay from one another in a fan pattern. This type of delamination is undesirable since the blade tips are moved from their original positioning closer to the photoreceptor. This change in positioning means that the blades can either swipe through process control patches along the photoreceptor or can be close enough that they electro-statically attract the toner and contaminate the backside lead edge of the next print media or sheet.

As a result, to solve the problem of delamination at high speed printing, there is a need for an improved TAB that substantially eliminates the unwanted delamination of the TAB.

INCORPORATION BY REFERENCE

The following references, the disclosures of which are incorporated in their entireties by reference herein, are mentioned:

U.S. Pat. No. 7,356,297, issued Apr. 8, 2008, entitled "CURVED TRANSFER ASSIST BLADE," by David Montfort, Eliud Robles-Flores, John R. Falvo, and Edward W. Schnepf.

U.S. Pat. No. 7,471,922, issued Dec. 30, 2008, entitled "SEGMENTED TRANSFER ASSIST BLADE," by Eliud Robles-Flores, Bruce J. Parks, Edward W. Schnepf, and David Montfort.

U.S. Pat. No. 6,233,423, issued May 15, 2001, entitled "TRANSFER APPARATUS WITH DUAL TRANSFER-ASSIST BLADES," by Gerald M. Fletcher, Christian O. Abreu, John T. Buzzelli, and Palghat S. Ramesh.

U.S. Patent Application Publication No. 2003/0108369, published Jun. 12, 2003, entitled "SEQUENTIAL TRANSFER ASSIST BLADE ASSEMBLY," by Youti Kuo, Douglas A. McKeown, David K. Ahl, and Robert A. Gross.

BRIEF DESCRIPTION

An imaging system and a constrained transfer assist blade (CTAB) assembly are disclosed that includes an upper blade with biasing features configured to constrain primary pressure blades against a lifter assembly (i.e., a fulcrum point), in which they articulate about. As a result, the primary pressure blades are kept from delaminating. The CTAB assembly is adapted to bias media (e.g., a paper sheet or like medium) toward a photoreceptor device of a printing machine. For example, the CTAB assembly comprises a blade member having at least one blade segment that includes pressure blades movable toward the photoreceptor device for biasing media toward the photoreceptor device. One or more biasing features constrain the pressure blades from splaying toward the photoreceptor device. Splaying occurs as a result of delamination or separation of the blades from one another, such as in an electrostatic field that may repel the pressure blades from one another.

In another embodiment, a CTAB assembly has a first blade segment that includes one or more first pressure blades that are movable toward the photoreceptor device and a first biasing feature. The first blade segment also includes a first wear layer overlaying an outer portion of the first blade segment that contacts the backside of the media for directing the media toward the photoreceptor device. A second blade segment further includes one or more second pressure blades, a second biasing feature, and a second wear layer overlaying an outer portion of the second blade segment that contacts the backside of the media for directing the media toward the photoreceptor device. In certain embodiments, the first and second blade segments partially overlap one another to eliminate gaps therebetween.

DETAILED DESCRIPTION

An imaging system and apparatus are disclosed that provide for an improved transfer assist blade (TAB) that is constrained from delaminating and decreases the amount of blade levitation that is experienced by the TAB assembly. Blade levitation includes distances caused by the blades of the TAB splaying from one another as well as separation distances from a fulcrum point where a lifter assembly contacts the blades to lift them to a printing media, such as a copy sheet. For example, a constrained transfer assist blade (CTAB) is disclosed that substantially eliminates the delamination, which is particularly pronounced when printing is performed at increased speeds.

Figure 1:
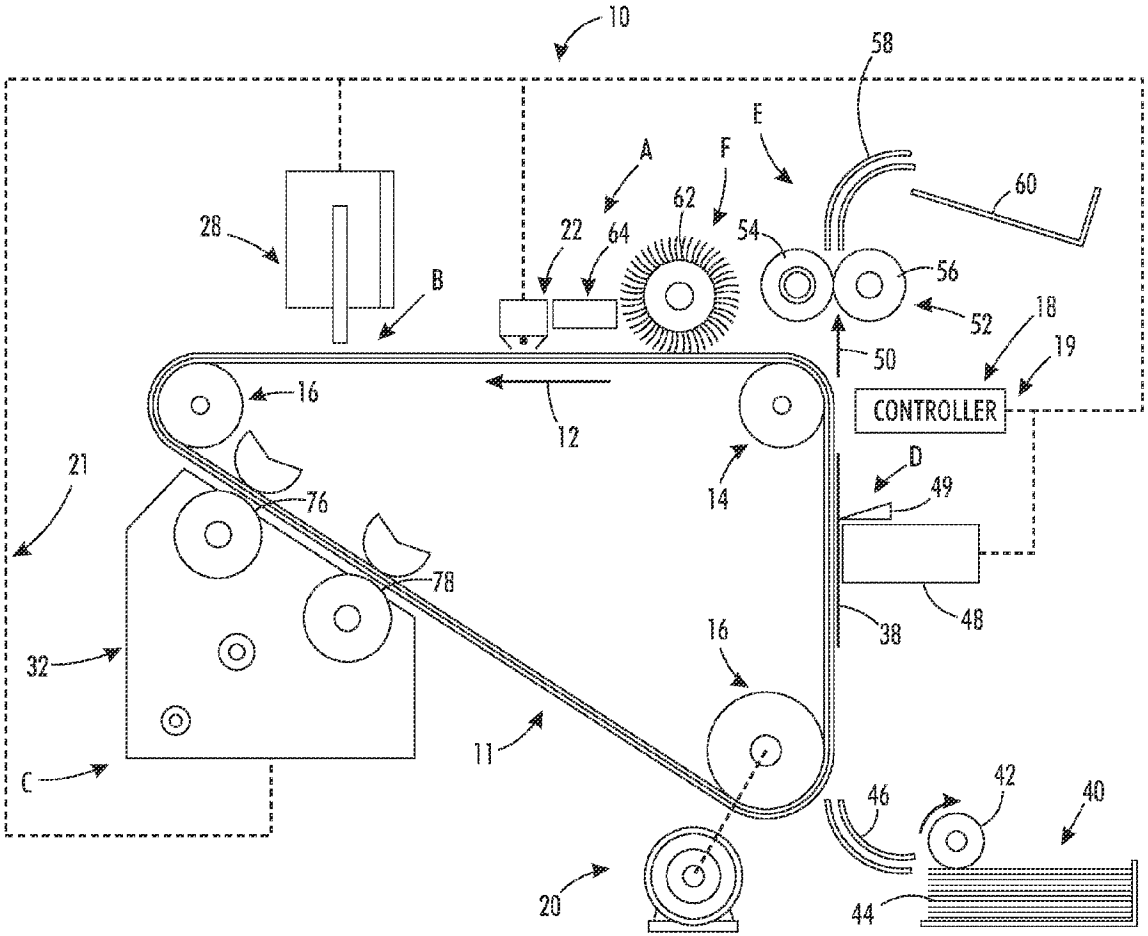
FIG. 1 is a schematic representation of an exemplary print imaging system.

FIG. 1 schematically depicts the various components of an illustrative electrophotographic printing/imaging system 10. A similar system is shown, for example, in U.S. Pat. No. 7,356,297, issued Apr. 8, 2008, entitled "CURVED TRANSFER ASSIST BLADE," by David Montfort et al., U.S. Pat. No. 7,471,922, issued Dec. 30, 2008, entitled "SEGMENTED TRANSFER ASSIST BLADE," by Eliud Robles-Flores et al., U.S. Pat. No. 6,233,423, issued May 15, 2001, entitled "TRANSFER APPARATUS WITH DUAL TRANSFER-ASSIST BLADES," by Gerald M. Fletcher et al., and U.S. Patent Application Publication No. 2003/0108369, published Jun. 12, 2003, entitled "SEQUENTIAL TRANSFER ASSIST BLADE ASSEMBLY," by Youti Kuo et al., which are incorporated herein by reference. The various processing stations employed in the FIG. 1 printing machine are well known to one of ordinary skill in the art, and thus, are discussed herein briefly for purposes of exemplifying various embodiments of this disclosure.

The printing machine shown in FIG. 1 employs a photoconductor 11, such as a photoconductive belt or any other suitable type of photoreceptor for transferring latent images to a media. The photoconductive belt illustrated, for example, moves in the direction of arrow 12 to advance successive portions of the photoconductive surface of the belt through the various stations. As shown, photoreceptor 11 is entrained about rollers 14 and 16, which are mounted to be freely rotatable with a drive roller rotated by a motor 20 to advance the belt in the direction of the arrow 12.

A controller 18 receives signals from various sensors in a feedback loop 21 at a feedback input 19 and is configured to store into memory data received. Initially, a portion of belt 11 passes through a charging station A. At charging station A, a corona generation device 22 charges the SZ portion of the photoconductive surface of belt 11 to a charge, for example, a relatively high, substantially uniform negative potential. Next, the charged portion of the photoconductive surface is advanced through an exposure station B. At exposure station B, after the exterior surface of photoconductive belt 11 is charged, the charged portion thereof advances to an exposure device 28. The exposure device includes a raster output scanner (ROS), which illuminates the charged portion of the exterior surface of photoconductive belt 11 to record a first electrostatic latent image thereon. Alternatively, a light emitting diode (LED) may be used or any other suitable exposure devices as one of ordinary skill in the art will appreciate. The exposure device 28 selectively illuminates the photoreceptor in areas requiring image development. As a result of light exposure in these areas, the photoreceptor 11 is selectively discharged resulting in an electrostatic latent image corresponding to the desired print image. The photoreceptor 11 then advances the electrostatic latent image to a development station C.

At development station C, a development apparatus indicated generally by the reference numeral 32, transports toner particles to develop the electrostatic latent image recorded on the photoconductive surface. Toner particles are transferred from the development apparatus to the latent image on the belt, forming a toner powder image on the belt, which is advanced to transfer station D.

At transfer station D, a sheet of support material or print media 38 is moved into contact with a toner powder image, which is developed on the photoreceptor and contacts a support material or print media 38 with the transfer station D, which includes a dicorotron 48 with a constrained transfer assist blade (CTAB) 49, for example, that provides for electrostatic and mechanical image transfer thereat.

The print media 38 is advanced to transfer station D by a sheet feeding apparatus 40, which could include a feed roll 42 that contacts the uppermost sheet of a stack of sheets 44. Feed roll 42 rotates to advance the uppermost sheet from stack 44 into chute 46. Chute 46 directs the advancing sheet of support material 38 into contact with the photoconductive surface of photoreceptor 11 in a timed sequence so that the toner powder image developed thereon contacts the advancing sheet of support material at transfer station D at a print zone. After transfer, the sheet continues to move in the direction of arrow 50 into a conveyor (not shown) which advances the sheet to fusing station E.

In one embodiment, the CTAB 49 actuates by engaging the backside of the print media or sheet 38 and disengages quickly in order to apply uniform pressure to the entire backside and to not touch toner particulate at an inter document zone area. For example, an increased speed from 110 pages per minutes speed to 137 pages per minute is achieved with a three millimeter image to edge border also being improved to a smaller allotted amount.

Further along, fusing station E includes a fusing device 52, which permanently affixes the transferred powder image to sheet 38. Sheet 38 passes between a fuser roller 54 and a back-up roller 56 with the toner powder image contacting fuser roller 54, and thus, making the toner powder image permanently affixed to sheet 38. Chute 58 then advances the sheet to catch tray 60. Residual particles are removed from the photoconductive surface at cleaning station F, which can include a brush 62 for example. An erase station 64 is also included for an erase step that may be provided before or after the cleaning station F. The erase station 64 brings the photoreceptor voltage to a uniform low voltage level before the next charging cycle, effectively "erasing" residual negative charge therefrom.

Figure 2:
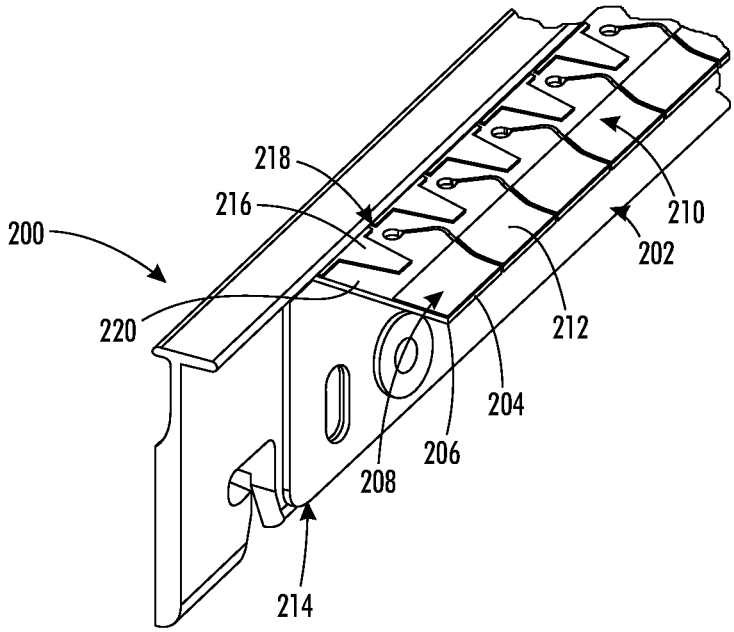
FIG. 2 is a schematic representation of an exemplary constrained transfer assist blade for print imaging systems.

Referring now to FIG. 2, illustrated is an exemplary aspect of a CTAB assembly 200 according to the present disclosure. A portion of the CTAB assembly 200 is illustrated that includes a blade member 202 having at least one blade segment 204. The blade member 202 can include one or more blade segments having a same width or different widths according to a size of a printing media used for transferring latent images thereon with the assembly 200. For example, copy sheets of wider widths, in which the CTAB assembly presses toward the photoreceptor for transfer would employ more blade segments 204 of the blade 202 to ensure a uniform pressure force along the width of the sheet of the wider sheet.

The blade member 202 includes two layers, an underlying layer 206 and an upper layer 208. Both layers form together to form part of a flexible blade member that actuates by a lifter assembly (not shown) to bias a print media toward a photoreceptor. The underlying layer 206 includes one or more pressure layers, which may include biaxially-oriented polyethylene terephthalate, such as Mylar or other like polyester film material that provides flexibility and high tensile strength.

The upper layer 208 includes two separate features overlaying the underlying layer 206 of the blade member 202 and residing within the same plain above a top surface of the underlying layer 206. One such feature is a wear layer 210 that extends over and above an outer portion 212 of the one or more blade segments 204. For example, the wear layer 210 can extend over a tip of each blade segment 204 and overlaps the underlying layer 206 from the tip of an outer edge of the blade member 202 that protrudes outward at a right angle with respect to a lower section 214 for support.

In addition, the upper layer 208 further includes a bias feature 216 or a constraining blade section, which operates as a constraining blade overlapping the underlying layer 206 in order to constrain the one or more underlying layers 206 from delaminating upward. Delamination of the underlying layer 206 occurs by the one or more layers splaying upward within an electrostatic charge field, which causes decreasing distance between the photoreceptor and the CTAB 200. Consequently, the blade member 202 separates from a lifter assembly and the blade tips can either swipe through process control patches as the photoreceptor rotates and/or electrostatically attract toner that can contaminate the backside lead edge of a subsequent print sheet.

The bias feature 216 overlays an inner portion 218 or inner edge of a top surface 220 of the underlying layer 206. This inner portion 218, in which the bias feature 216 spans, extends from the lower section 214 up to a lifter contact region 220, which is between the bias feature 216 and the wear layer 210. In one embodiment, the constraining blades or bias features 216 are trapezoidal in shape in order to facilitate efficient and easy cleaning of the CTAB 200. Although, other shapes in which the bias features 216 are formed also envisioned as within the scope of the present disclosure.

The upper layer 208 of the blade member 202 thus includes two different features separate from one another and on the same directional plane that laterally extends along the top surface of the one or more underlying layers 206. In one embodiment, the bias feature 216 and the wear layer 210 comprises different materials from one another. For example, the wear layer 210 includes an ultra-high molecular weight material that is different from the bias feature 216, which may include a biaxially-oriented polyethylene terephthalate, such as Mylar or other type polyester film material. The wear layer 216 functions to provide a material at the outer portion 212 of the blade member 202 and/or each segment 204 that protects from wear and improves blade life. The outer portion 212 especially operates as a contact region of the blade member 202 that repeatedly comes into contact with the backside of the printing sheets. Rather than covering the entire top surface of the underlying layer 206 with the wear layer 210, the outer portions of the blade and any segments is covered with the wear layer 210. This allows for the additional bias feature 216 to also reside on the top surface as part of the upper layer 208 and maintains wear resistance to the blade member 202 while improving response times of the CTAB 200, which is further explained below.

Figure 3:
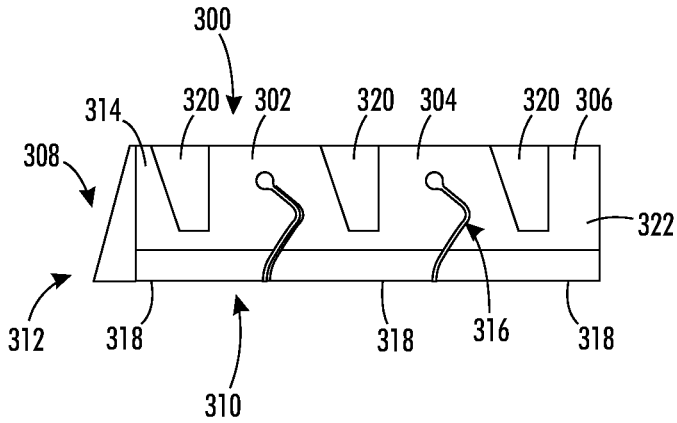
FIG. 3 is a schematic representation of an exemplary constrained transfer assist blade for print imaging systems.

Referring now to FIG. 3, illustrated is an exemplary blade member 300 in a CTAB assembly for biasing a print media to a photoreceptor for a print machine, such as a xerographic imaging system or the like. The blade member 300 includes a plurality of blade segments 302, 304, 306 that are each utilized for biasing printing media of different widths toward a photoreceptor for image transfer thereupon. The blade segments 302, 304, 306 include a plurality of underlying layers 308 and an upper layer 310.

The underlying layers 308 for pressure blades include at least one layer 312 forming a backside of the blade member 300 and a top layer 314 that provides top surface. In addition, the top layer 314 provides an overlapping portion 316 that is delineated by segmented curved lines of FIG. 3. The overlapping portion 316 substantially eliminates gaps between each of the blade segments 302, 304, 306. For example, the first segment 302 and the second segment 304 have the overlapping portion 316 with the last segment 306 not having the overlapping portion 316.

The upper layer 310 spans portions of the top surface of the underlying layers 308. For example, the upper layer 310 includes a wear layer 318 and a constraining layer 320, which forms biasing features at each blade segment for constraining the underlying layers 310. The wear layer 318 and the constraining layer 320 both reside on the top surface of the top layer 314 and are opposite from one another with a gap therebetween, which forms a lifter contact region 322 at each blade segment. The region 322 separates the wear layer 318 and the constraining layer 320 and allows for different features thereat to be formed with different materials. For example, although the wear layer 318 and the constraining layer 320 are adjacent to one another on the top surface, each form separate features that are opposite from one another. The wear layer 318 extends past an outer edge of the blade member (e.g., two or three millimeters) and up to the lifter contact region 322. Further, the constraining layer 320 of each segment laterally extends from an inner edge to the contact region 322, which is a region where a lifter assembly (not shown) contacts the blade member 300 underneath the underlying layers 308 as a fulcrum point.

Figure 4:
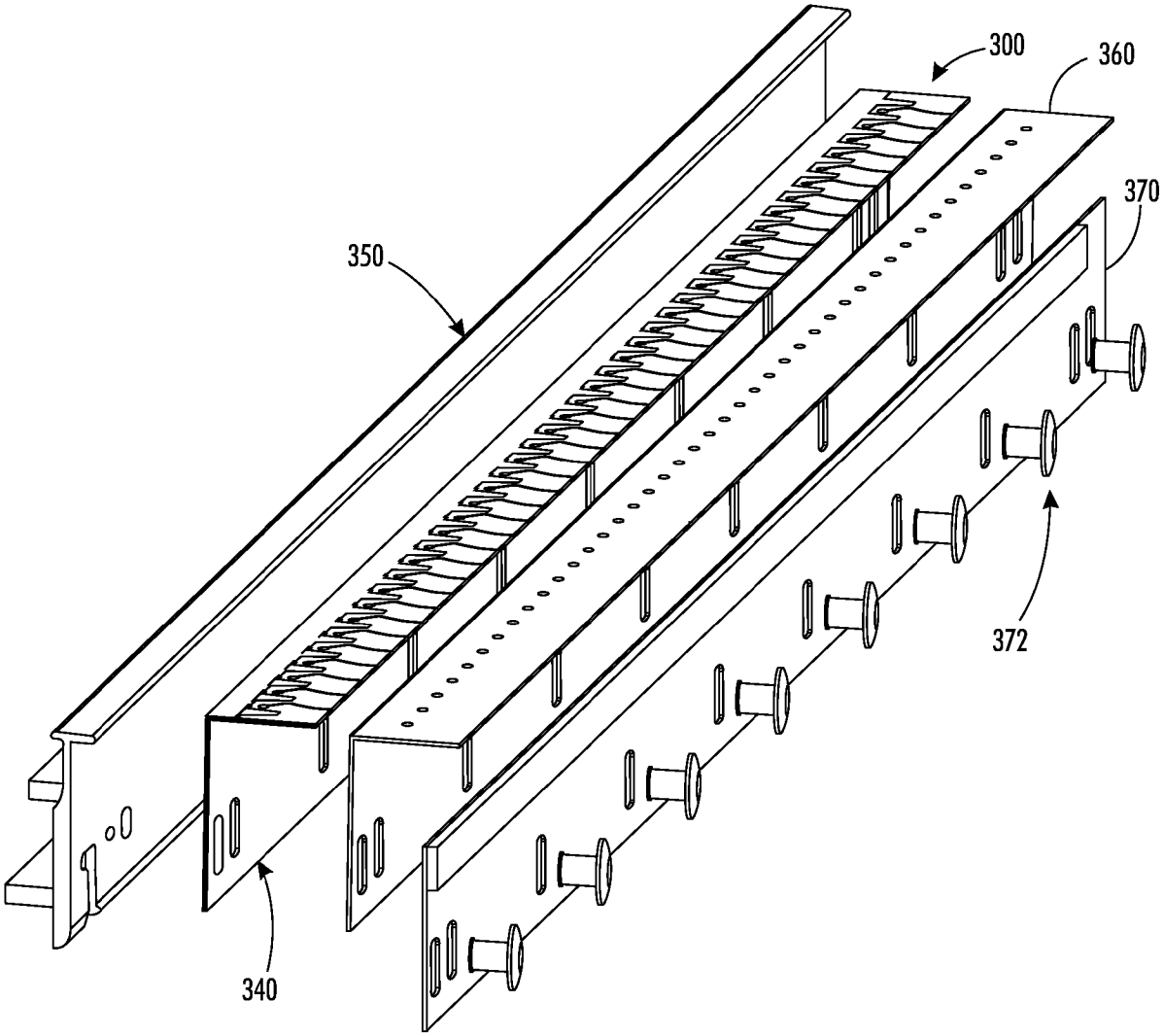
FIG. 4 is a schematic representation of an exemplary constrained transfer assist blade for print imaging systems.

FIG. 4 illustrates an example of architecture for securing the blade member 300 having a lower section 340 that is held by attachments against a back plate extrusion 350. For example, a first attachment 360 secures the blade member 300 with a second attachment 370 having rivets 372 thereat. The first and second attachments secure the blade member 300 against the back plate 350, which has a bend (e.g., a ninety degree bend or other angle) to provide proper upper blade orientation against the back plate 350. Other embodiments for assembling the blade member for proper orientation are also envisioned as one of ordinary skill in the art can appreciate.

Figure 5:
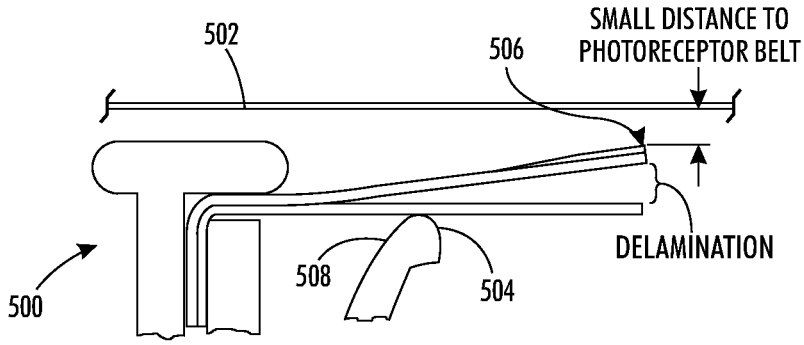
FIG. 5 is a schematic representation of an exemplary constrained transfer assist blade for print imaging systems.

FIG. 5 illustrates a side view of a portion of an exemplary imaging forming system having a blade assembly 500. The blade assembly 500 includes different layers that are not constrained by a constraining layer with bias features as discussed above. As a result, the layers of the assembly 500 have splayed towards a photoreceptor 502 of the system and are close to the photoreceptor even when a lifter assembly 508 is deactivated or is in a rest position by not lifting during an inter document zone passing along the photoreceptor. Consequently, a separation distance 504 is observed as well as a delamination distance 506 of the blade layers. The blade distance and delamination distance together increase a blade levitation distance above acceptable levels, such as between 0.6 millimeters to 0.8 millimeters, for example.

An advantage of the present blade assembly disclosed herein is that the delamination distance is eliminated and blade levitation distances are within acceptable levels even when printing at a high speed (e.g., 137 pages per minute or higher). In addition, image to edge borders of three millimeter or less can be provided without decreasing the inter document zone between images on the photoreceptor 502, where control patches or different sensors are often employed.

Figure 6:
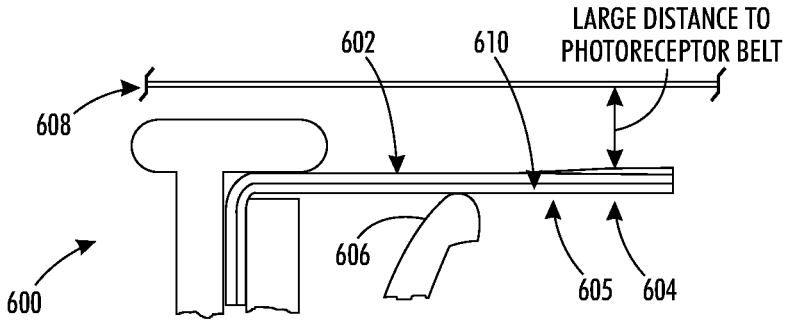
FIG. 6 is a schematic representation of an exemplary constrained transfer assist blade for print imaging systems.

FIG. 6 illustrates an example of a side view of an imaging forming system having a blade assembly 600 as another exemplary aspect of the present disclosure. The assembly 600 has a constraining layer 602 that forms biasing features for biasing a blade member 604 having an underlying pressure layer 605 towards a lifter assembly 606 and away from a photoreceptor 608. The constraining layer 602 laterally extends along a top surface of the blade member 604 to a lifter contact region 610, in which the lifter assembly 606 contacts underneath. As the photoreceptor 608 rotates, the lifter assembly 606 lifts the blade member 604 to a backside of a print media sheet for images to be transferred to the top side of the sheet. Once a trailing edge of the sheet approaches the lifter assembly 606, the lifter assembly deactivates to release the blade member 604 from the back of the sheet and draw it away from the photoreceptor 608 to not interfere with the inter document zone (i.e., space between images on the photoreceptor) and/or any control patches thereat.

Figure 7:
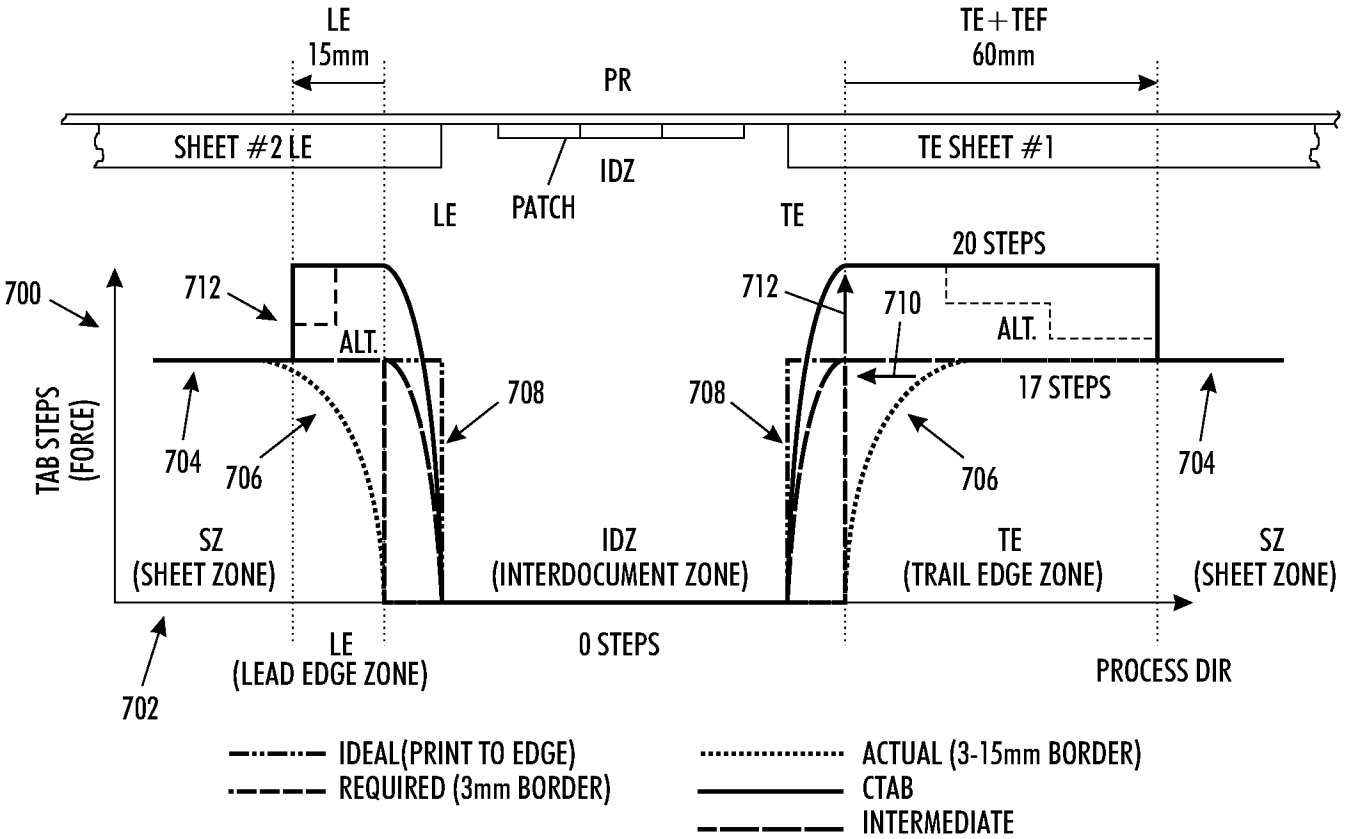
FIG. 7 is a graph illustrating pressure profiles of exemplary aspects of the present disclosure.

FIG. 7 illustrates a graph of different profiles of physical forces provided by a constrained transfer assist blade disclosed herein and other blades of prior art. Each line represents a pressure force profile that a transfer blade exerts upon the back side of a print media or copy sheet toward a photoreceptor PR. A trailing edge (TE) of a first sheet zone (Sheet #1) moves along the photoreceptor PR and a leading edge (LE) of a second sheet (Sheet #2) follows the first sheet zone (Sheet #1) with an inter document zone (IDZ) therebetween. Within the IDZ is a patch (e.g., a control patch or other like sensor) that may monitor quality control or other parameters of a printing system at the photoreceptor. A horizontal axis 702 represents distances along the photoreceptor PR and a vertical axis 700 represents the pressure force caused by steps of a step motor for transfer blades to bias a print sheet to the photoreceptor.

In general, a three millimeter image-to-edge border is an allotted specification for printing images and a pressure profile for this border is illustrated as a required curve 704. This represents a drop in the pressure forces to zero within three millimeters of the leading edge (LE) and from the trailing edge (TE) of each sheet in order to obtain a three millimeter image-to-edge border on a printed sheet and not interfere with the IDZ area. In order to meet this specification, an actual curve 706 is shown where the transfer blade releases pressure within three to fifteen millimeters within each leading and trailing edges of the sheet zones. This, in turn, enables each printed sheet to be actuated and de-actuated from the photoreceptor PR with transfer blades and meet specifications. A relative ideal curve 708 illustrates an impractical situation where the printed sheet is fully actuated up to an exact point where each sheet zone begins and ends during transfer of the images from the photoreceptor PR to a printed sheet. An intermediate curve 710 illustrates an improved pressure force profile that approaches the shape of the ideal curve 708. However, the CTAB assembly discussed provides a CTAB curve 712 that is an even larger improvement that allows for an increased pressure force, shown as twenty steps as opposed to seventeen steps of a step motor with curve 704. One advantage that the present CTAB assembly disclosed herein allows is an improved image-to-edge border profile so that printing can be performed closer to the edges of a printed sheet or media acquiring the transferred images. This is caused by improved blade response times as shown in FIG. 7 with the CTAB curve 712. In addition, trail edge flip defects are mitigated due to increased pressures at various stages, such as at points labeled alt in FIG. 7. Trail edge defects are caused when print media of heavier weight flips at the trail edge of each sheet and causes toner defects on the edge of each sheet. Not only does the CTAB assembly disclosed herein eliminate delamination distances, as discussed above, but further advantages are provided with the elimination of trail edge defects, faster response times, no backside sheet contamination and other defects. Further, the wear layer of each blade segment discussed above in conjunction with the constraint layer designs increases blade life by providing stiffness to the outer portion, without contributing to a decrease in response time illustrated in FIG. 7.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A constrained transfer assist blade (CTAB) assembly adapted to bias media toward a photoreceptor device of a printing machine, comprising:

a blade member having at least one blade segment that includes pressure blades movable toward the photoreceptor device for biasing media toward the photoreceptor device;

a wear layer that overlays a top surface of the pressure blades of the at least one blade segment and spans the top surface of the at least one segment from an outer edge to a lifter contact region where a lifter assembly actuates the at least one blade segment toward the photoreceptor device to contact the outer edge with the media; and, a biasing feature to constrain the pressure blades from splaying toward the photoreceptor device wherein the biasing feature is disposed to overlay the top surface of the pressure blades adjacent and opposite to the wear layer by laterally extending from an inner edge that is opposite the outer edge and extending to the lifter contact region of the at least one segment.

2. The CTAB assembly of claim 1, wherein the biasing feature laterally extends outward from a base at a distance that is less than a distance that the primary pressure blades extend outward from the base to cause the primary pressure blades of the segments to be constrained together.

3. The CTAB assembly of claim 1, wherein the biasing feature has a trapezoidal shape that constrains the pressure blade against a lifter assembly that actuates the at least one blade segment for moving the media toward the photoreceptor device.

4. The CTAB assembly of claim 1, wherein the at least one blade segment has at least two pressure blades that comprise a polymer based material for flexibly moving the media toward the photoreceptor and is a different polymer than a wear layer that overlays a top surface of the at least one blade segment and spans a contact area of the top surface from an outer edge of the at least one segment to a lifter contact region where a lifter assembly actuates the at least one blade segment toward the photoreceptor device.

5. The CTAB assembly of claim 1, wherein the one or more biasing features keep the pressure blades from delaminating from one another toward the photoreceptor by constraining the pressure blades against a lifter assembly configured to move the at least one blade segment toward the photoreceptor by contacting a bottom surface of the pressure blades.

6. A constrained transfer assist blade (CTAB) assembly adapted to bias media toward a photoreceptor device for a printing machine, comprising:

a first blade segment that includes:

a first pressure blade that is movable toward the photoreceptor device;

a first biasing feature; and a first wear layer overlaying an outer portion of the first blade segment that contacts the backside of the media for directing the media toward the photoreceptor device;

a second blade segment that includes:

a second pressure blade;

a second biasing feature; and a second wear layer overlaying an outer portion of the second blade segment that contacts the backside of the media for directing the media toward the photoreceptor device wherein the first and second biasing features constrain the first pressure blade and the second pressure blade respectively to keep the first and second pressure blades from delaminating toward the photoreceptor device.

7. The CTAB assembly of claim 6, wherein the first and second blade segments partially overlap one another to eliminate gaps therebetween.

8. The CTAB assembly of claim 6, wherein the first blade segment is independently movable toward the photoreceptor device by a lifter assembly for a first media size, and the first and second segments are movable toward the photoreceptor device by the lifter assembly for a second different media size.

9. The CTAB assembly of claim 6, wherein the first biasing feature and the second biasing feature adjacently abut a base supporting an inner portion of the first blade segment and extend partially outward to first and second lifter contact regions where a lifter assembly contacts for moving media toward the photoreceptor device.

10. The CTAB assembly of claim 9, wherein the first biasing feature and the first wear layer are located separately on a top surface of the first pressure blade, and the second biasing feature and the second wear layer are located separately on a top surface of the second pressure blade.

11. The CTAB assembly of claim 9, wherein the first wear layer and the second wear layer are located at an outer portion of the first and second blade segment that extends from an outer edge to the first and second lifter contact regions respectively.

12. An image forming system, comprising:

a photoreceptor for transferring latent images to a media;

a transfer station including a constrained transfer assist blade, which transfers images to a printing media by transferring toner from the photoreceptor to the media and a lifter assembly that moves the constrained transfer assist blade with the media towards the photoreceptor;

wherein the constrained transfer assist blade includes:

an upper layer having a bias feature and a wear layer separate from the bias feature, and one or more underlying layers wherein the bias feature and the wear layer are separated by a lifter contact region on a top surface of the one or more underlying layers.

13. The image forming system of claim 12, wherein the bias feature constrains the underlying layers and prevents delamination of the one or more underlying layers from occurring toward the photoreceptor.

14. The image forming system of claim 12, wherein the bias feature comprises a biaxially-oriented polyethylene terephthalate material.

15. The image forming system of claim 12, wherein the wear layer comprises a different material from the bias feature and covers an outer portion of the underlying layers that contacts the backside of the media.

16. The image forming system of claim 12, wherein the constrained transfer assist blade includes a plurality of segments having the upper layer and the one or more underlying layers, and wherein at least one segment has at least one underlying layer that overlaps at least one underlying layer of a different segment.

* * * * *